US005404831A

United States Patent [19]

Miller

[11] Patent Number: 5,404,831

[45] Date of Patent: Apr. 11, 1995

[54] COLLAPSIBLE ANCHOR ASSEMBLY

[76] Inventor: Raymond A. Miller, 198 Mast Rd., Brick Town, N.J. 08723

[21] Appl. No.: 985,800

[22] Filed: Dec. 2, 1992

[51] Int. Cl.[6] ..... B63B 21/38

[52] U.S. Cl. ..... 114/306; 114/301

[58] Field of Search ..... 114/298, 294, 301–310; 102/411; 405/224; 52/162, 163; 188/7; D12/215

[56] References Cited

U.S. PATENT DOCUMENTS

| | | | |
|---|---|---|---|
| 2,526,214 | 10/1950 | Faraone | 114/303 |
| 2,643,630 | 6/1953 | Buck | 114/303 |
| 2,735,395 | 2/1956 | Ballman | 114/303 |
| 3,793,977 | 2/1974 | Ziegler | 114/305 |
| 4,763,597 | 8/1988 | Stupakis | 114/297 |
| 4,823,721 | 4/1989 | Pekny | 114/303 |

*Primary Examiner*—Robert J. Oberleitner
*Assistant Examiner*—Clifford T. Bartz
*Attorney, Agent, or Firm*—Louis E. Marn

[57] ABSTRACT

There is disclosed an anchor assembly comprised of a shank member on which are disposed cooperating fluke members which are rotably positioned on the shank member wherein each fluke member is formed with stabilizer portions capable of assuming a nestling relationship therebetween in deployed cooperation of the anchor assembly.

10 Claims, 2 Drawing Sheets

COLLAPSIBLE ANCHOR ASSEMBLY

BACKGROUND OF THE INVENTION

1. Field of the Invention

This invention relates to an anchor assembly, and more particularly to a anchor assembly capable of being folded and collapsed into an assembly of substantially reduced size.

2. Description of the Prior Art

Over the recent years, the design of anchors for ships and boats have seen a significant change in design concept. Generally, anchors are formed of a shank having a fluke arrangement at one end, the other end being connected to an anchor chain. Generally, the fluke members are attached to the shank to permit a limited amount of angular movement to permit the fluke to engage the sea bottom upon dragging of the anchor assembly thereover. The removal of the anchor from the sea bottom involves the raising of the shank to a vertical position during which the flukes are disengaged from the sea bottom.

Considering the limited space, particularly on small crafts, there has been a plurality of efforts directed to anchor assemblies capable of being folded and unfolded to provide more readily storage capabilities and of reduced storage volume requirements. For example, in U.S. Pat. No. 3,485,199 to Schuman, there is disclosed an anchor assembly having arm members which are pivotable about a common shank member to provide a substantially compact member when the arm members are nestled against the shank member. U.S. Pat. No. 3,807,340 to Diorio et al., there is disclosed a folding anchor having not only folding fluke members, but upper foldable stack members. Other forms of foldable anchor assemblies include U.S. Pat. No. 4,763,597 to Stupakis, U.S. Pat. No. 4,798,159 to Taylor et al. and U.S. Pat. No. 4,958,586 to Stupakis. All of such assemblies require elaborate construction of pin members, nuts, bolts, springs and the like, as well as a certain amount of mechanical engineering understanding to deploy the anchor assembly into a usable form.

OBJECTS OF THE INVENTION

It is an object of the present invention to provide a collapsible anchor assembly obviating the use of tools to effect assembly.

A still further object of the present invention is to provide a collapsible anchor assembly requiring only nominal skill to deploy same into a usable anchor assembly.

A still further object of the present invention is to provide a collapsible anchor assembly which may be readily folded from an assembled configuration into a substantially compact sub-assembly for facile storage.

SUMMARY OF THE INVENTION

These and other objects of the present invention are achieved by an anchor assembly comprised of a shank member on which are disposed cooperating fluke members which are rotatably positioned on the shank member wherein each fluke member is formed with stabilizer portions capable of assuming a nestling relationship therebetween in deployed cooperation of the anchor assembly.

BRIEF DESCRIPTION OF THE DRAWINGS

Other features and advantages of the present invention will become more apparent from the following detailed description when taken with the accompanying drawings wherein.

DETAILED DESCRIPTION OF THE DRAWINGS

Figure 1:
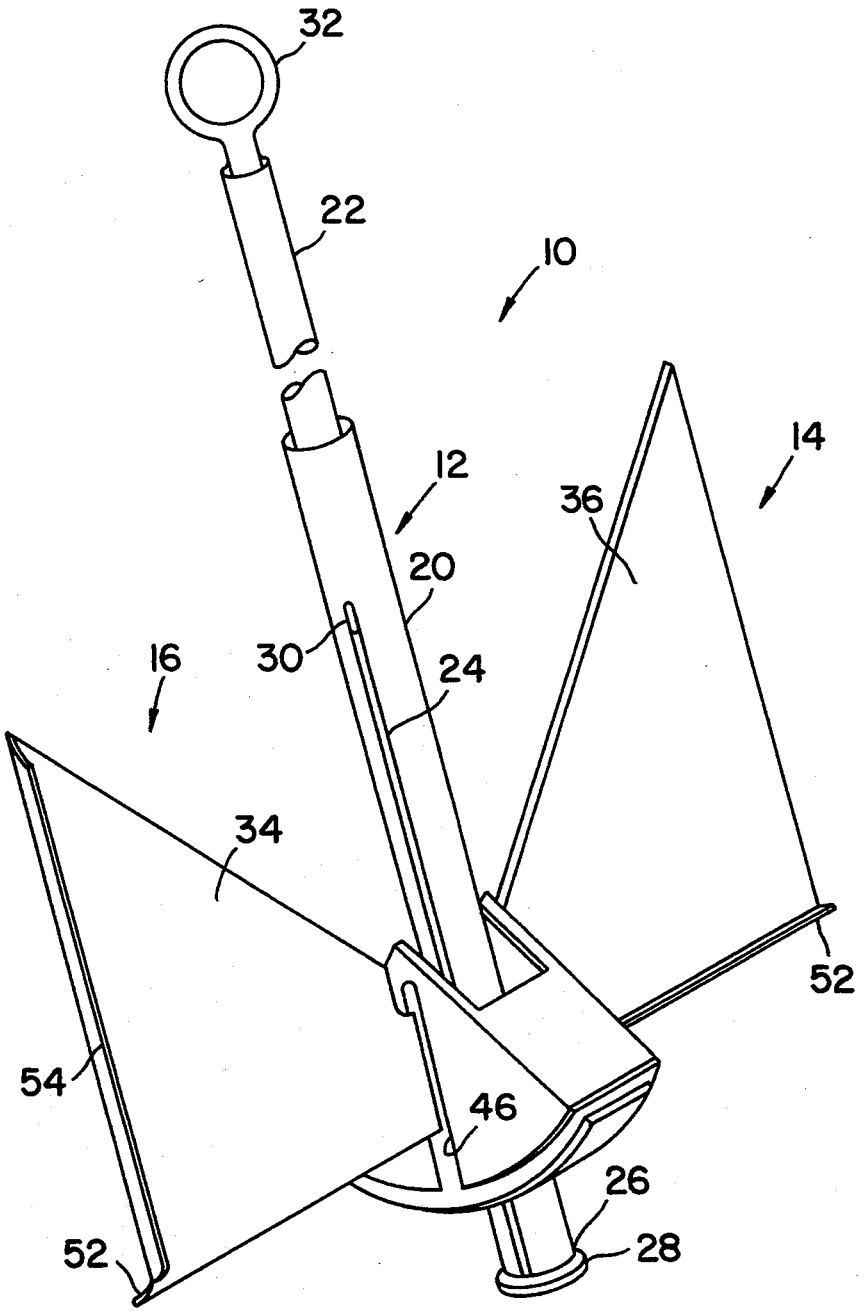
FIG. 1 is an isometric view of the anchor assembly of the present invention in an assembled configuration.

Referring now to the drawings and particularly FIG. 1, there is illustrated an anchor assembly, generally indicated as one of the present invention, generally indicated as 10, and comprised of a shank member 12 on which are positioned cooperating upper and lower fluke members 14 and 16. The shank member 12 is a telescoping assembly comprised of an outer tubular member 20 and an inner rod member 22 slidably positioned therein. The tube member 20 is formed with an elongated slot 24 along a longitudinal axis thereof and enclosed at a lower end 26 by a disc member 28 mounted, such as by welding, to the end 26 of the tube member 20. The inner rod member 22 is provided with a tab member 30 for restrictive slidable engagement within the elongated slot 24 of the tube member 20. An end of the rod member 22 extending outwardly from the tube member 20 is provided with a ring member 32 mounted, such as by welding, to the rod member 22. Generally, the rod member 22 is of a length substantially equal to the length of the tube member, such that in a collapsed configuration, the end of the rod member 22 including the tab member 30 contacts the disc member 28 of the tube member 20.

Figure 3:
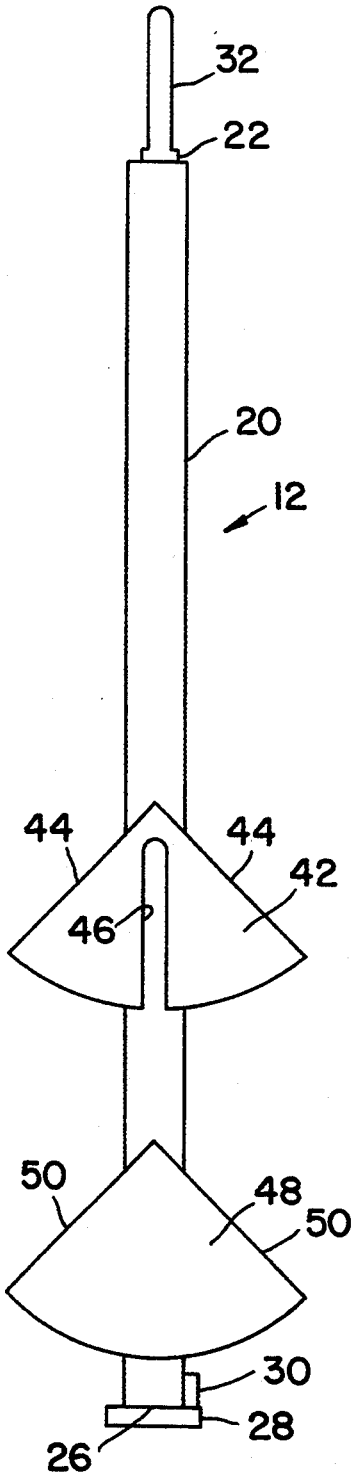
FIG. 3 is a left side view of the anchor assembly of FIG. 2.

The fluke members 14 and 16 are slidably positioned on the shank member 12 in seriatum relationship. The fluke members 14 and 16 are formed of fluke portions 34 and 36 with stabilizer portions, generally indicated as 38 and 40, respectively mounted, such as by welding (w) to the respective fluke portions 34 and 36. The stabilizer portion 40 of the lower fluke member 16 is dimensioned to be nestled within the stabilizer portion 38 of the upper fluke member 14, as more fully hereinafter described. The stabilizer portion 38 of the upper fluke member 14 is formed of parallelly-disposed triangularly-shaped plate members 42 mounted to intermediate plate members 44 with plate member 42, opposite the plate member 42 welded to the fluke member 14, formed with an elongated slot 46, referring particularly to FIG. 3. The stabilizer portion 40 of the lower fluke member 16 is similarly formed of parallelly-disposed triangularly-shaped plate member 48 mounted to plate members 50. The plate members 50 of the stabilizer portion 38 of the lower fluke member 46 are of a width smaller than the plate members 44 of the upper fluke member 14 to provide the nestling interrelationship of the stabilizer portions 38 and 40 of the fluke members 14 and 16 in an operational configuration of the anchor assembly 10 of the present invention, as more fully hereinafter described. Additionally, width of the plate members 50 of the stabilizer portion 40 of the fluke member 16 is smaller than the diameter of the disc member 28 of the shank member 20 to provide support to the fluke member 16 and thus to fluke member 14 on the shank member 12. Each fluke members 14 and 16 is formed with a lower upturned edge 52 and an upturned lateral side edge 54 to provide strength as well as sliding resistance for more effective holding.

Figure 2:
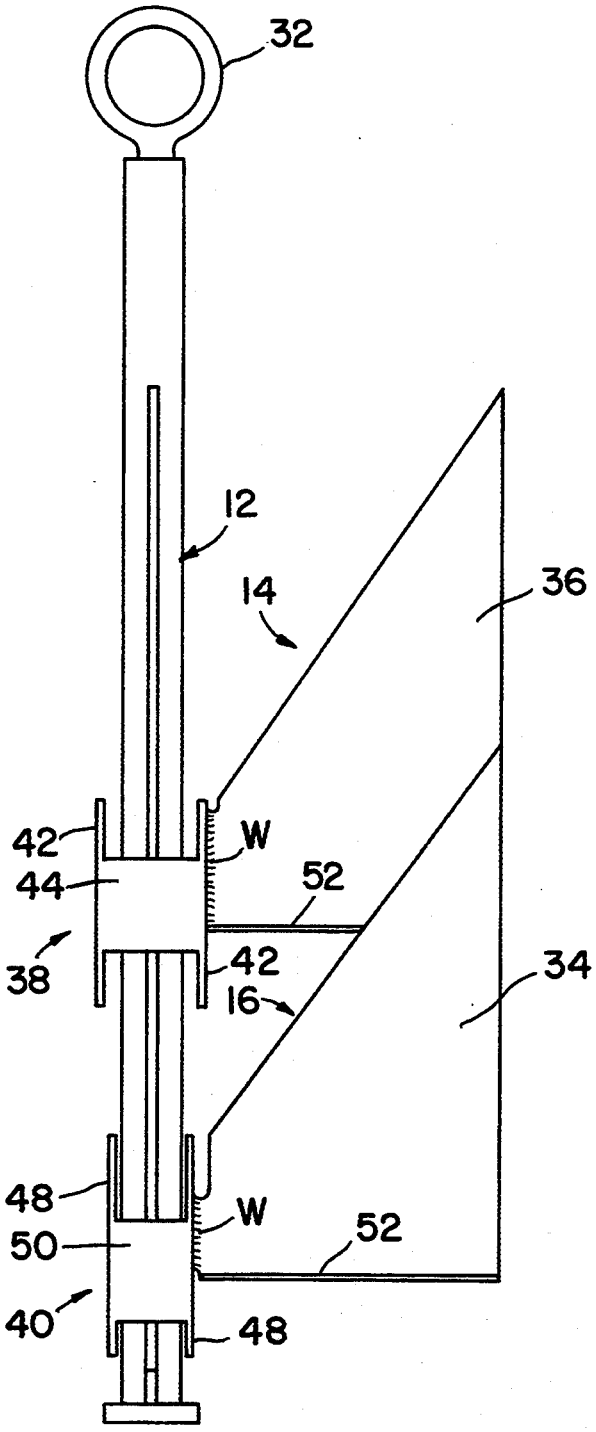
FIG. 2 is a front view of the anchor assembly of the present invention in a somewhat collapsed and folded configuration.

In operation, in a folded configuration of the anchor assembly 10 of the present invention, referring particularly to FIG. 2, the inner rod member 22 is fully disposed within the outer tube member 12 with the fluke member 14 and 16 positioned together in a cooperating generally planar fitting relationship, it being understood that the fluke members 14 and 16 may assume a closer fitting relationship as that depicted in FIG. 2, limited by contacting relationship between plate members 44 with plate members 50 of the respective fluke member.

To effect deployment of the anchor assembly 10 of the present invention, one of the fluke members 14 or 16, referring to FIG. 2 is rotated 180° about the shank member 12 with respect to the other fluke member with the stabilizer portion 38 of the upper fluke member 14 thereafter being positioned over the stabilizer portion 40 of the lower fluke member 16 into a nestled and interlockinging relationship, referring to FIG. 1, with the slot 46 of the stabilizer 38 receiving the weld of the lower fluke member 16 of the stabilizer member 40. As understood by one skilled in the art, the stabilizer members serve to maintain the proper position of the fluke members of the anchor assembly 10 for penetration into the anchoring substrate. Additionally, it will be understood that the size of the fluke portions and shank may be varied as a function of the size of the vessel consistent with convenient manipulation by the user, and that vessels of lengths of up to 30 feet may conveniently utilize the anchor assembly of the present invention thereby eliminating on deck stowing devices and the like.

Additionally, it will be understood by one skilled in the art that the anchor assembly of the present invention may be readily disassembled into its component parts by withdrawal of the shank member 12 through the respective stabilizer portions after suitable aligning of the ring 32 with respect to the axis of the stabilizer portions of the fluke members.

While the present invention has been described in connection with an exemplary embodiment thereof, it will be understood that many modifications will be apparent to those or ordinary skill in the art; and that this application is intended to cover any adaptations or variations thereof. Therefore, it is manifestly intended that this invention be only limited by the claims and the equivalents thereof.

What is claimed:

1. An anchor assembly which comprises:

a shank member including a ring member;

a first fluke member including a stabilizer portion rotatably disposed on said shank member; and a second fluke member including a stabilizer portion disposed on said shank member, said stabilizer portions of said fluke members being formed of parallelly-disposed triangularly-shaped plate members spaced apart by intermediate plate members, said stabilizer portion of said second fluke member being dimensioned to receive said stabilizer portion of said first fluke member in nestled relationship therebetween to effect deployed cooperation of said fluke members with respect to said shank member.

2. The anchor assembly as defined in claim 1 wherein said second fluke member is rotatably disposed on said shank member.

3. The anchor assembly as defined in claim 1 wherein each fluke member is comprised of a fluke portion including an upturned edge along a lateral side thereof.

4. The anchor assembly as defined in claim 1 wherein one triangularly-shaped plate member of each stabilizer portion is welded to a respective fluke portion of each fluke member.

5. The anchor assembly as defined in claim 4 wherein said triangularly-shaped plate member of said first fluke member opposite triangularly-shaped plate member welded to said fluke portion is formed with a slot for positioning said stabilizer portion of said first fluke member about said stabilizer portion of said second fluke member at a position where one of said triangularly-shaped plate members is welded to said fluke portion of said second fluke member to effect generally planar fitting relationship between said fluke members.

6. The anchor assembly as defined in claim 1 wherein said shank member includes an end cap for cooperating with said mounting means to retain said fluke members of said shank member.

7. The anchor assembly as defined in claim 1 wherein said shank member is formed of telescoping members.

8. The anchor assembly as defined in claim 7 wherein said shank member is comprised of an outer tubular member and an inner rod member.

9. The anchor assembly as defined in claim 8 wherein said outer tubular member is provided with an elongated slot for a tab member of said rod member to permit limited movement of said rod member within said outer tubular member.

10. The anchor assembly as defined in claim 1 wherein said intermediate plate members of said first fluke member are dimensioned slightly larger than said intermediate plate members of said second fluke member to permit nestled relationship between said stabilizer portions of said fluke members.

* * * * *